United States Patent [19]

Sowder

[11] 4,099,272

[45] Jul. 11, 1978

[54] BATHING APPARATUS FOR INVALIDS

[76] Inventor: Gene F. Sowder, 1009 Ogden St., Denver, Colo. 80218

[21] Appl. No.: 806,986

[22] Filed: Jun. 16, 1977

[51] Int. Cl.[2] ..... A47K 3/22

[52] U.S. Cl. ..... 4/148; 4/150; 4/156; 4/181; 4/185 S

[58] Field of Search ..... 4/173 R, 148, 150, 156, 4/155, 181, 185 S

[56] References Cited

U.S. PATENT DOCUMENTS

| | | | |
|---|---|---|---|
| 1,739,163 | 12/1929 | Mitchell | 4/148 |
| 3,407,411 | 10/1968 | Stevens | 4/185 R |
| 3,863,275 | 2/1975 | Brendgord et al. | 4/148 |

*Primary Examiner*—Richard E. Aegerter
*Assistant Examiner*—L. Footland
*Attorney, Agent, or Firm*—Henri J. A. Charmasson

[57] ABSTRACT

A perambulatory self-contained apparatus for facilitating care of invalids characterized by a narrow sit-down type bathtub mounted on casters. A lateral gate provides for easy access into the bathtub from ground level. Associated with the bathtub are a plurality of heated supply tanks, electrically powered pumps, mixing valves and conduits for selectively conveying liquids from the tanks or from the tub drainage outlet towards a shower ring or a hand-held spray unit.

1 Claim, 4 Drawing Figures

BATHING APPARATUS FOR INVALIDS

BACKGROUND OF THE INVENTION

This invention relates to apparatuses used in hospitals, convalescent and retirement homes for bathing invalid patients. Some elderly or invalid persons may have limited mobility and, in particular, may be unable to step over the edge of a conventional bathtub, or to negotiate the small step at the entrance of a shower enclosure. Sponge baths may thus be the only means of bathing such patients. Without special appratuses these patients may be unable to soak their bodies in soothing solutions such as those used for the treatment of bedsores.

Various types of devices have been proposed in the past for facilitating the care of bedfast patients such as those disclosed in U.S. Pats. Nos. 2,560,997 F. O. THOMPSON; 3,407,411 E. V. STEVENS; 3,613,127 J. M. BOND and 3,701,170 J. M. BOND. These patents however, disclose devices designed for completely immobile patients with no ambulatory ability whatsoever. The applicant is not aware of any existing device designed for the type of limitedly ambulatory patients described above.

SUMMARY OF THE INVENTION

A perambulatory bathtub with self-contained heated supply tanks, pump and spraying devices and a lateral gate opening having a low treshold in order to provide easy access to persons who, because of old age of infirmity, cannot step over the edge of a conventional bathtub.

The invention provides a bathing apparatus for invalid persons which is compact enough to be rolled through standard size door openings close to the sedentary patients, and stowed away in conventional closet spaces. The invention can be used to give wet treatment to invalid persons either by submersion, shower or hand spraying. The apparatus is designed to allow the patient to operate it himself or to be operated from the outside by an attendent. The invention also provides a plurality of supply tanks which may contain different types of wetting solutions for skin or scalp treatment. Recirculation of the drained solution through the shower and spraying system can be optionally effected.

IN THE DRAWING

DESCRIPTION OF THE PREFERRED EMBODIMENT

Figure 1:
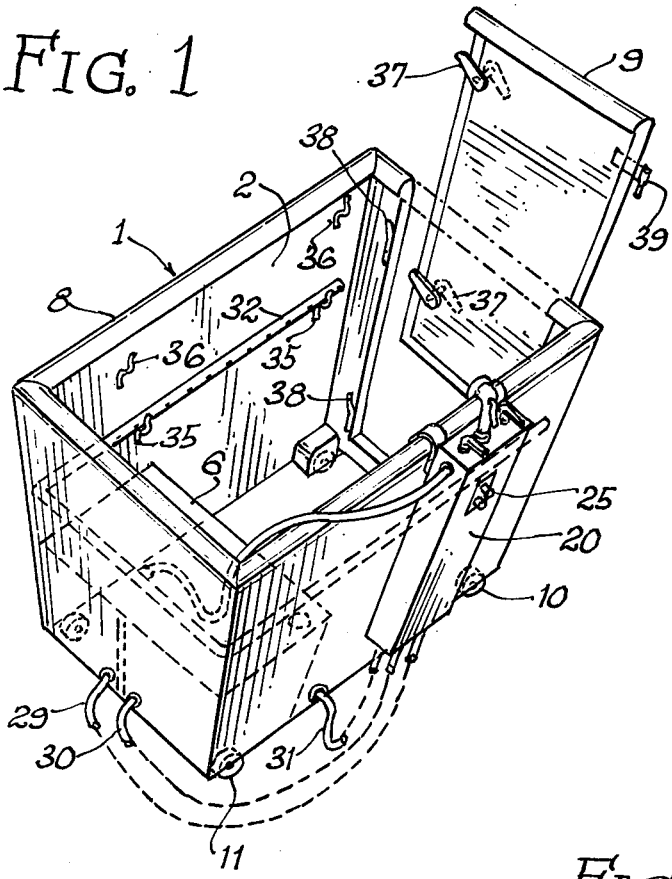
FIG. 1 is a perspective view of the entire apparatus showing the frontal door separated from the main unit.
Figure 2:
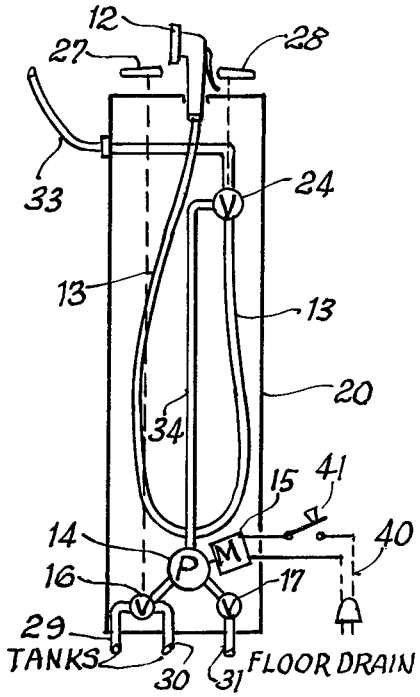
FIG. 2 is a schematized view of the control console.
Figure 3:
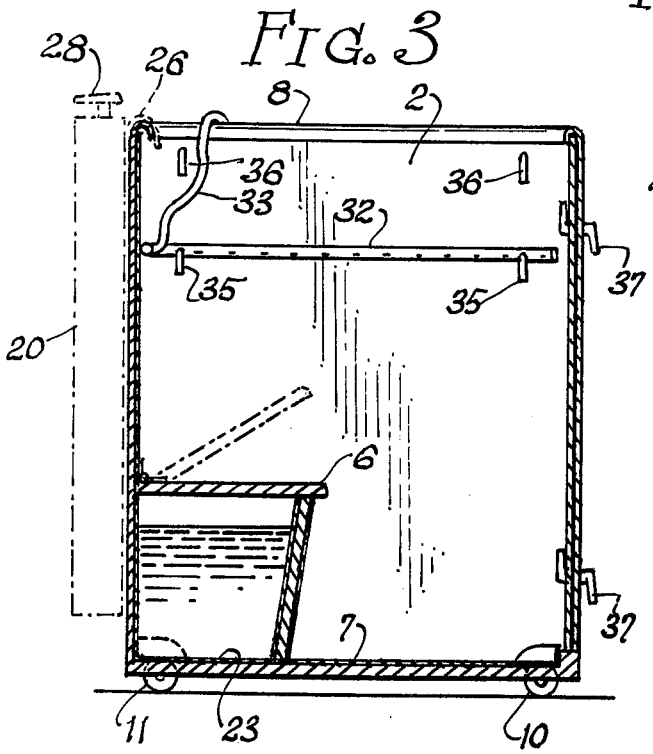
FIG. 3 is a longitudinal cross sectional view of the apparatus seen from the right side of the unit.
Figure 4:
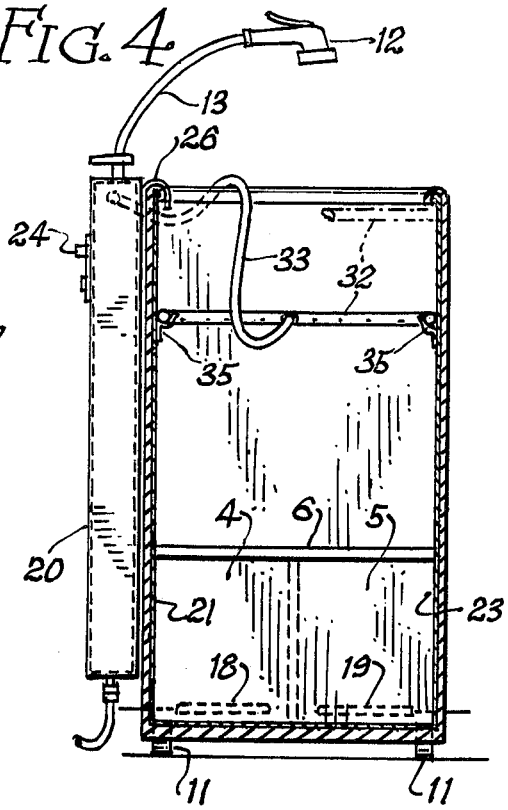
FIG. 4 is a lateral cross sectional view of the apparatus seen from the front of the unit.

Referring to the drawing, there is shown a bathing apparatus 1 which comprises a rectangular enclosure 2, of approximately one hundred centimeters in height, open at the top. In one of the walls, referred to as the front wall of the apparatus 1, is a gate opening, closed by a door 9. The door 9 supported by two hinges 39 can be hermetically sealed by means of latches 37, 38. When the door 9 is sealed the enclosure 2 provides a watertight basin. Along the back wall of the enclosure 2 is a bench-like protrusion 6. The enclosure 2 is mounted on two pairs of casters 10, 11. These casters 10, 11 are partially ensconced into the floor of the enclosure 2, in order to minimize the clearance between the bottom of the enclosure 2 and ground. The door 9 extends almost down to the floor 7 the enclosure 2, and approximately 5 centimeters from ground, leaving a very shallow area 3 for drainage purposes on the floor 7 of the enclosure 2.

Under the bench-like protrusion 6 covered by a hinged lead are housed two supply tanks 4, 5. The inside wall of each tank 4, 5 are lined by the skin of a collapsible bag 21, 23. Each bag 21, 23 is fused at its lower end to an outlet conduit 29, 30 which protrudes through the backwall of the enclosure 2. Thermostat controlled heating elements 18, 19 are included in the lower section of the tanks 4, 5. A drainage outlet conduit 31 protruding through the lower right side of the enclosure 2 is used to drain liquids from the inside of the enclosure 2.

These three outlet conduits, 29, 30, 31 extend into three flexible conduits leading to a control unit. The control unit comprise an elongated movable console 20 suspended over the rim 8 of enclosure 2 by a pair of hooks 26. The console 20 houses a reversible pump 14 powered by an electrical motor 15 controlled by a switch 41. Outlet conduits 29, 30, 31 are connected to the pump 14 by way of mixing valves 16, 17 controlled by handles 27 on the top of the console 20. These valves 16, 17 are used to selectively connect the pump 14 to either tank 4, tank 5, or the drainage outlet 31; or to any combination of them.

The opposite end of the pump is connected to a conduit 34 leading to a two-position valve 24. The two position valve 24 gives access to flexible conduits 13 and 33. One of these conduits 33 leads to a U-shaped shower rod 32 having a plurality of spray holes along its inside edge. The shower rod 32 is supported by sets of hooks 35, 36 mounted in the interior back and side walls of the enclosure 2, at various levels. The second flexible conduit 13 leads to a detachable hand-held spray unit 12 which normally rests in a nesting hole in the top of the console 20.

Handle 27 which controls the mixing valve 16, 17 has three basic dial positions labeled "ONE," "TWO," and "TUB." When the dial is set to "ONE" the pump 14 is connected to the left side tank 4, when the dial is set to "TWO" the pump is connected to the right side tank 5. When the dial is set to "TUB" the pump 14 is connected to the drainage outlet conduit 31. Intermediate settings of the dial between "ONE" and "TWO" or "TUB" and "ONE" or "TWO" allows the operator to select a mixture of the respective corresponding sources. Handle 28 which controls the two-position valve 24 has a dial labeled "SHOWER" and "HAND-SPRAY".

A control panel 25 groups the electrical controls for the apparatus which comprises: the pump motor 15 ON/OFF switch and its directional two-position control switch labeled "FILL" and "USE," and the temperature setting control knobs for the heating elements 18, 19. A power cord 40 extending from the console 20 is is used to plug the apparatus into a household current outlet.

The apparatus is made ready for use by rolling it close to a convenient source of hot and cold water. Mixing valve control 28 is set on the "HAND-SPRAY" position while valve control 27 is set to one of the supply tank positions "ONE" or "TWO." The pump control is set to "FILL." The hand spray unit 12 is detached from conduit 13 and the end of the conduit is connected to a supply of liquid to be stored in the selected supply tank. The motor 15 is turned until the selected tank is filled. The second tank can be filled in the same manner as the first. Both tanks 4, 5 can be filled with hot or lukewarm water and the desired temperature can be maintained by the heating elements 18, 19 which are thermostatically controlled to keep the contents of the tanks 4, 5 to the temperatures dialed on the panel 25. Alternatively, the second tank may be used to store cold water to be mixed by the operator with the hot water to obtain the desired spray water temperature. The tanks 4, 5 may also be filled with medicated solutions such as those used for the treatment of bed sores or other skin ailments. The availability of two different tanks is particularly useful when applying treatment to a patient which requires alternate applications of two separate solutions such as a detergent solution followed by a rinsing solution.

Once the patient has entered the enclosure and the door has been securely closed the bathtub can be filled by switching mixing valve control 27 to the "TUB" position. The pump control is switched to "USE" position in order to activate the spraying unit. Before reopening the door 9, the bath water may be emptied into a nearby sink or pumped back into the supply tanks 4, 5 via conduit 13. The hand spray unit can be operated by the patient himself or by an attendant standing outside the enclosure 2. The console 20 may be moved around the enclosure 2 for the best convenience of the user. The pump 14 is equipped with two bypass conduits, not shown on the drawing. The bypass are controlled in alternate direction by check valves designed to relieve the pump pressure when the tanks are filled or the spraying units are shut off.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. A device for bathing invalid and elderly persons which comprises:

- a mobile bathtub mounted on casters having a gate-like opening in one of its walls;
- a door within said opening;
- watertight means for securing the door within said opening;
- at least one liquid supply tank;
- a outlet at the bottom of said tank;
- at least one liquid spraying means;
- a drainage outlet at the bottom of the tub;
- at least one valve for selectively connecting said spray means to one or more of said outlets;
- conduit means between said spray means and said valve and between said valve and said outlets;
- a pump for forcing liquid from said outlets through the conduits toward said valve; and
- a movable console suspendable over the rim of the bathtub housing said pump and means for controlling said valve and pump.

* * * * *